US005445326A

United States Patent [19]

Ferro et al.

[11] Patent Number: 5,445,326

[45] Date of Patent: Aug. 29, 1995

[54] EMERGENCY TRUNK INTERIOR RELEASE LATCH

[76] Inventors: Joseph Ferro; Lisamarie Marchioli, both of 1431 Wolf St., Philadelphia, Pa. 19145

[21] Appl. No.: 170,826

[22] Filed: Dec. 21, 1993

[51] Int. Cl.[6] ..... E05B 63/20

[52] U.S. Cl. ..... 292/336; 292/203; 292/DIG. 43; 292/DIG. 65

[58] Field of Search ..... 292/DIG. 65, DIG. 43, 292/92, 225, 203, 218, 336

[56] References Cited

U.S. PATENT DOCUMENTS

| | | | |
|---|---|---|---|
| 2,872,233 | 2/1959 | Bordner, Jr. | 292/DIG. 65 X |
| 3,601,434 | 8/1971 | Fargo | 292/DIG. 65 X |
| 3,894,761 | 7/1975 | Brennan, Jr. | 292/225 |
| 3,992,909 | 11/1976 | McGhee | 292/DIG. 65 X |
| 4,073,520 | 2/1978 | Tsuchiya | 292/216 |
| 4,080,812 | 3/1978 | Knott | 292/DIG. 65 X |
| 4,155,233 | 5/1979 | Lira | 292/92 X |
| 4,205,868 | 6/1980 | Kurth | 292/336.3 X |
| 4,478,441 | 10/1984 | Fiordellisi et al. | 292/216 |
| 5,054,826 | 10/1991 | Dow et al. | 292/DIG. 43 X |

FOREIGN PATENT DOCUMENTS

| | | | |
|---|---|---|---|
| 3207718 | 9/1983 | Germany | 292/DIG. 43 |
| 313072 | 12/1933 | Italy | 292/225 |

*Primary Examiner*—Rodney M. Lindsey

[57] ABSTRACT

A latch for releasably securing the trunk lid of a vehicle which may be actuated by a person inside the trunk in emergency situations. The device includes a latch assembly operable by both a conventional exterior lock assembly and a release assembly positioned within the trunk compartment. The release assembly utilizes a flexible cable coupled to a detent lever within the latch in which the cable may be pulled by a person inside the trunk to open the trunk lid. Alternatively or additionally, the release assembly may utilize a spring loaded button which engages the detent lever to release the lid upon actuation. An alternate embodiment of the present invention includes a luminescent coating on the release assembly.

1 Claim, 3 Drawing Sheets

Fig. 1
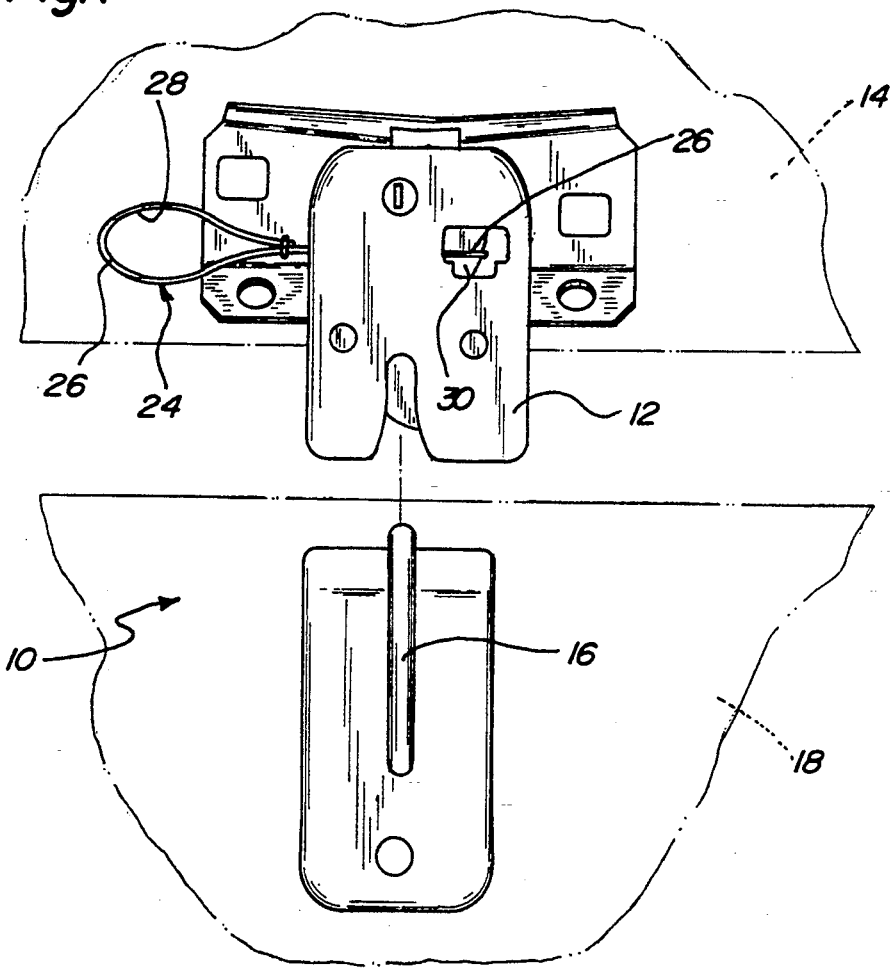
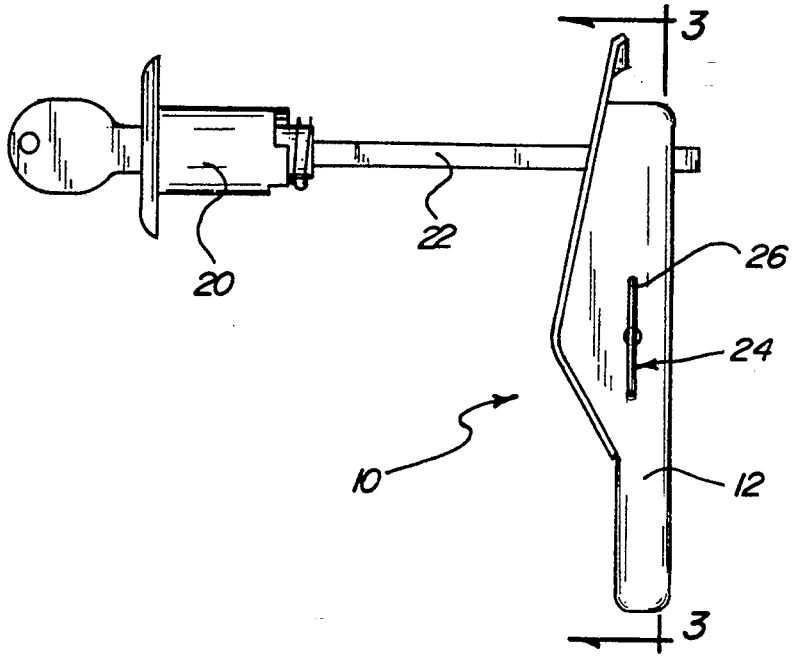
Fig. 2

EMERGENCY TRUNK INTERIOR RELEASE LATCH

BACKGROUND OF THE INVENTION

1. Field of the Invention

The present invention relates to latches and more particularly pertains to an emergency trunk interior release latch for releasably securing the trunk lid of a vehicle which may be actuated by a person inside the trunk in emergency situations.

2. Description of the Prior Art

The use of latches is known in the prior art. More specifically, latches heretofore devised and utilized for the purpose of securing vehicle components are known to consist basically of familiar, expected and obvious structural configurations, notwithstanding the myriad of designs encompassed by the crowded prior art which have been developed for the fulfillment of countless objectives and requirements.

For example, a device for locking a trunk lid of a motor vehicle is illustrated in U.S. Pat. No. 4,974,885 which utilizes a base plate secured to a trunk structure, a latch member rotatably supported on the base plate for holding a striker secured to the trunk lid and a detent lever being engagable with the latch member to hold the latch member in a locking position. The device operates such that when the trunk lid is closed the lock lever rotates the latch member to move the striker into a locking position and when the trunk lid is opened, the lock lever rotates the detent lever to release the detent lever from the latch member. The device effectively reduces the force required to secure the trunk lid of the motor vehicle.

A vehicular trunk lid latch assembly is disclosed in U.S. Pat. No. 3,961,504 which includes a housing, a pair of latching members, a cam member, a spring loaded lever rotatively mounted intermediate to cam member and one of the latching members and a shaft extending into the housing from a lock cylinder assembly. In the event of removal of the shaft, the spring-loaded lever will snap away from the cam member into an inoperable position, thereby preventing any unlatching operation thereafter by the insertion of a probe or screw driver to rotate the cam member.

Another patent of interest is U.S. Pat. No. 4,979,384 which describes a trunk lid lock with remote release which employs a solenoid operated rotatable armature that acts directly on a leg of a rotatable latch plate which engages a lock bar. Upon energization of the solenoid, the armature is attracted to the solenoid, thereby causing it to disengage the latch plate so that the deck lid may be opened. The lid lock further includes a rotatable key cam which acts on the armature to enable a release of the deck lid through conventional external key actuation.

While these devices fulfill their respective, particular objectives and requirements, the aforementioned patents do not disclose a latch for releasably securing the trunk lid of a vehicle which may be actuated by a person inside the trunk compartment in emergency situations which includes a latch assembly operable by both a conventional exterior lock assembly and a release assembly positioned within the trunk compartment. Furthermore, none of the known prior art latches teach or suggest a trunk interior release latch provided with a luminescent interior release assembly.

In these respects, the emergency trunk interior release latch according to the present invention substantially departs from the conventional concepts and designs of the prior art, and in so doing provides an apparatus primarily developed for the purpose of releasably securing the trunk lid of a vehicle while providing for the release of such trunk lid by a person contained within the trunk compartment.

SUMMARY OF THE INVENTION

In view of the foregoing disadvantages inherent in the known types of emergency trunk interior release latch now present in the prior art, the present invention provides an improved emergency trunk interior release latch construction wherein the same can be utilized for releasably securing the trunk lid of a vehicle while allowing the trunk lid to be released by a person contained within the trunk compartment in emergency situations. As such, the general purpose of the present invention, which will be described subsequently in greater detail, is to provide a new and improved emergency trunk interior release latch apparatus which has all the advantages of the prior art emergency trunk interior release latch and none of the disadvantages.

To attain this, the present invention essentially comprises a latch for releasably securing the trunk lid of a vehicle which may be actuated by a person inside the trunk in emergency situations. The device includes a latch assembly operable by both a conventional exterior lock assembly and a release assembly positioned within the trunk compartment. The release assembly utilizes a flexible cable coupled to a detent lever within the latch in which the cable may be pulled by a person inside the trunk to open the trunk lid. Alternatively or additionally, the release assembly may utilize a spring loaded button which engages the detent lever to release the lid upon actuation. An alternate embodiment of the present invention includes a luminescent coating on the release assembly.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved emergency trunk interior release latch which has all the advantages of the prior art emergency trunk interior release latches mentioned heretofore and many novel features that result in a emergency trunk interior release latch which is not anticipated, rendered obvious, suggested, or even implied by any of the prior art latches, either alone or in any combination thereof.

It is another object of the present invention to provide a new and improved emergency trunk interior release latch which may be easily and efficiently manufactured and marketed.

It is a further object of the present invention to provide a new and improved emergency trunk interior release latch which is of a durable and reliable construction.

An even further object of the present invention is to provide a new and improved emergency trunk interior release latch which is susceptible of a low cost of manufacture with regard to both materials and labor, and which accordingly is then susceptible of low prices of sale to the consuming public, thereby making such emergency trunk interior release latches economically available to the buying public.

Still yet another object of the present invention is to provide a new and improved emergency trunk interior release latch which provides in the apparatuses and methods of the prior art some of the advantages thereof, while simultaneously overcoming some of the disadvantages normally associated therewith.

Still another object of the present invention is to provide a new emergency trunk interior release latch for releasably securing the trunk lid of a vehicle which may be actuated by a person inside the trunk compartment in emergency situations.

Yet another object of the present invention is to provide a new emergency trunk interior release latch which includes a latch assembly operable by both a conventional exterior lock assembly and a release assembly positioned within the trunk compartment.

Even still another object of the present invention is to provide a new emergency trunk interior release latch which includes an interior release assembly having a luminescent coating thereon so as to be readily visible by a person contained inside the trunk compartment.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a front elevation view of a first embodiment of an emergency trunk interior release latch comprising the present invention.

FIG. 2 is a side elevation view of the present invention illustrating engagement thereof to a conventional exterior lock assembly.

DESCRIPTION OF THE PREFERRED EMBODIMENT

Figure 3:
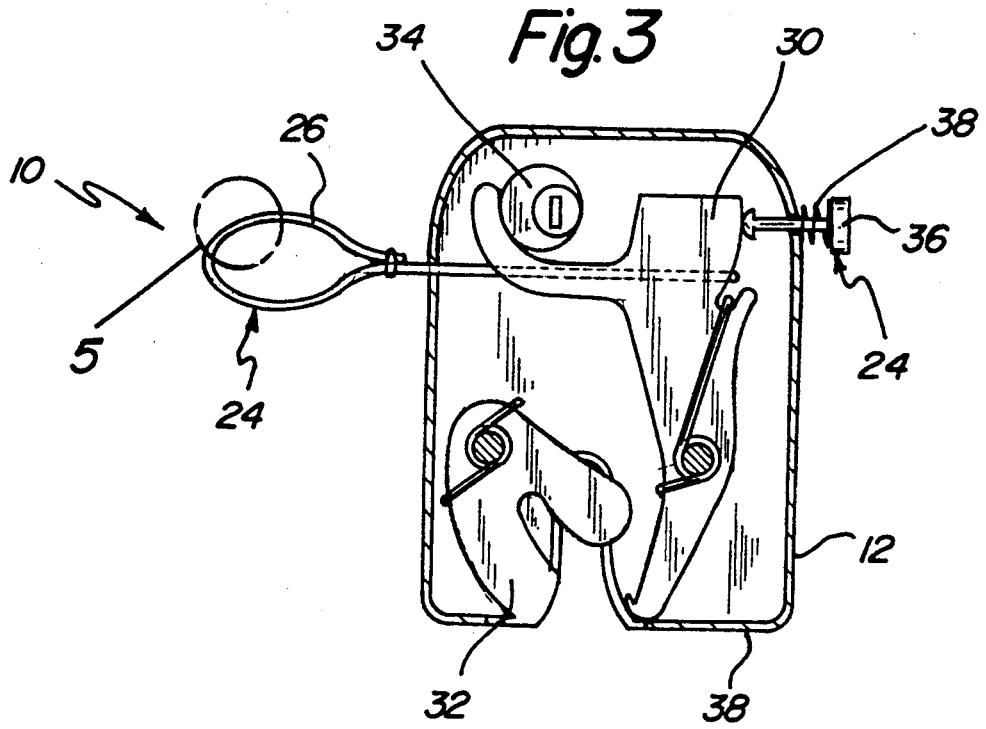
FIG. 3 is a cross sectional view taken along line 3—3 of FIG. 2.

With reference now to the drawings, and in particular to FIGS. 1–5 thereof, a first embodiment of a new emergency trunk interior release latch embodying the principles and concepts of the present invention and generally designated by the reference numeral 10 will be described.

The emergency trunk interior release latch 10 comprises a latch assembly 12 which may be releasably mounted by conventional unillustrated fasteners to a trunk lid 14, as best illustrated in FIG. 1. A catch 16 may be similarly mounted to the vehicle body 18 in a position such that a closing of the trunk lid 14 will engage the latch assembly 12 to the catch.

The latch assembly 12 may be released from the catch 16 by a conventional lock assembly 20 through a rotation of an extension member 22 providing mechanical communication therebetween, as best illustrated in FIG. 2. In addition, the latch assembly 12 may be released from the catch 16 by a person inside the trunk compartment through an actuation of a release assembly 24. The release assembly 24 includes a cable 26 formed into a loop 28 exterior of the latch assembly 12 and extending into the latch assembly through an unlabeled aperture where it is coupled to a detent lever 30. Thus, an actuation of the detent lever 30 from either the exterior of the vehicle through the lock 20 or from the interior of the trunk compartment through the release assembly 24 may be accomplished.

In use, the emergency trunk release latch 10 provides a means for a person locked within the trunk compartment to unlock and open the trunk lid. The invention 10 provides the person trapped within the trunk compartment a viable means of escaping from car jackets, kidnappers, and other criminally intent persons.

More specifically, it will be noted that the emergency trunk interior release latch 10 comprises a latch assembly 12 which may be fixedly coupled to a trunk lid 14 by conventional unillustrated threaded fasteners. The latch assembly 12 may be releasably engaged to a catch 16 which may be similarly mounted by unillustrated conventional threaded fasteners to the vehicle body 18, as best illustrated in FIG. 1.

Referring now to FIG. 3, it can be shown that the latch assembly 12 includes a detent lever pivotally mounted therein. A latching lever 32 is also pivotally mounted within the latch assembly 12 and is operable to capture a portion of the catch 16 when engaged to the same. Upon capturing a portion of the catch 16, the latching lever 32 pivots into engagement with the detent lever 30, whereby the latch assembly 12 becomes securely coupled to the catch 16. The latch assembly 12 may be released from the catch 16 by a pivoting of the detent lever 30 which allows the latching lever 32 to release the catch 16.

The detent lever 30 of the emergency interior release latch 10 may be pivoted away from the latch lever 32 by either a release cam 34 or a release assembly 24. The release cam 34 is mechanically coupled by an extension member 22 to an exterior lock 20 such that an actuation of the lock will cause a pivoting of the detent lever 30 and a subsequent release of the latch assembly 12 from the catch 16 through the above described structure.

The release assembly 24 is positioned within the interior of the trunk compartment, such that a person contained therein may release the latch assembly 12 to escape. The release assembly 24 is best illustrated in FIGS. 1 and 3 and it can be seen from these Figures that the release assembly comprises a cable 26 formed into a loop 28 and extending into the latch assembly 12 where it is coupled to the detent lever 30. As now can be understood, the loop 28 may be pulled by the person in the trunk compartment to pivot the detent lever 30 away from the latching lever 32 to release the latch assembly 12 from the catch 16.

Alternatively or additionally, the release assembly 24 may take the form of a pin 36 which is slidably supported within an unlabeled aperture extending through the housing 38 of the latch assembly 12, also illustrated in FIG. 3. A spring 38 is concentrically positioned upon the pin 36 to position the pin away from the detent lever 30 during normal operation of the latch assembly 12 from the exterior of the vehicle. However, should a person become trapped within the trunk compartment, the pin 36 may be depressed against a force of the spring 38, whereby the pin will engage the detent lever 30 to pivot the same away from the latching lever 32. In this manner, a person trapped within the trunk compartment may free himself from such confinement.

Figure 4:
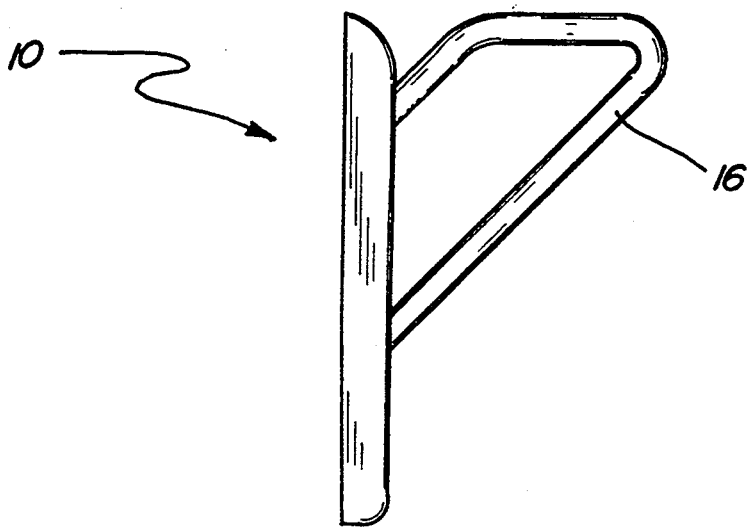
FIG. 4 is a side elevation view of a portion of the present invention.

FIG. 4 illustrates the catch 16 which may be releasably coupled to the latch assembly 12 as described above. Although a specific shape is illustrated for the catch 16, it is within the intent and preview of the present invention to include a catch of any conceivable shape which may be engaged to the latch assembly 12.

Figure 5:
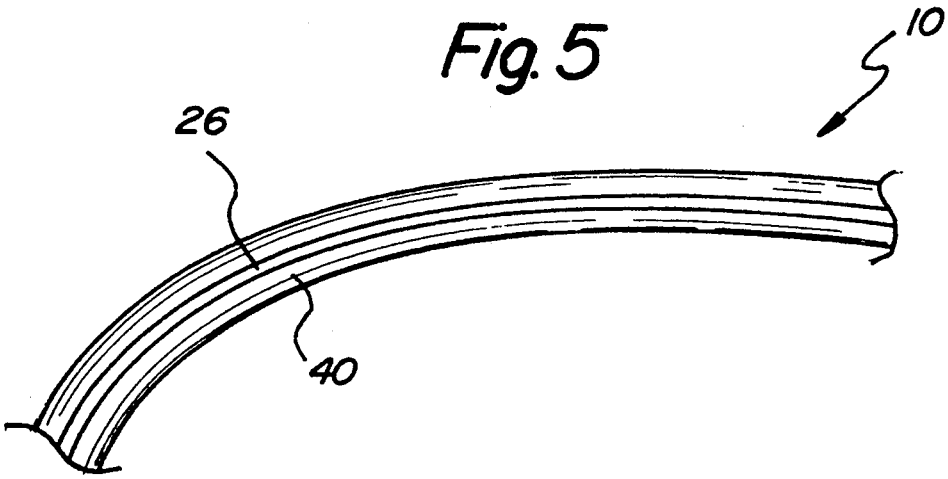
FIG. 5 is an enlarged front elevation view of the circled area of FIG. 3.

FIG. 5 is an enlarged elevation view of the circled area of FIG. 3 and it can be seen from this Figure that the cable 26 forming the release assembly 24 may be provided with a luminescent coating 40. The luminescent coating 40, or "glow-in-the-dark" coating as it is commonly known, will radiate sufficient light within the darkness of the trunk compartment to allow a person trapped therewithin to locate and subsequently operate the release assembly 24 as described above. Although illustrated for only the cable 26, the pin 36 may also be provided with a similar luminescent coating, thereby providing the same benefits and advantages.

In use, the emergency trunk release latch 10 provides a means for a person locked within the trunk compartment to unlock and open the trunk lid. The invention 10 provides the person trapped within the trunk compartment a viable means of escaping from car jackers, kidnappers, and other criminally intent persons.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An emergency trunk interior release latch comprising:

a housing having an aperture therethrough;

a latching lever pivotally mounted to said housing for receiving and capturing a catch;

a detent lever pivotally mounted to said housing for releasably securing said latching lever upon reception of said catch by said latching lever; and, a release assembly means operatively engaged with said detent lever for facilitating a release of said catch from said latching lever by a person from within a trunk compartment;

said release assembly means comprising a cable formed into a loop positioned exteriorly of said housing, a portion of said cable extending through said aperture in said housing and being operatively engaged with said detent lever, whereby said latching lever may be pivoted by pulling on said loop to release said detent lever; and, a luminescent coating on said loop.

* * * * *